US011905861B2

(12) United States Patent
Lee

(10) Patent No.: US 11,905,861 B2
(45) Date of Patent: Feb. 20, 2024

(54) MULTI-CAMSHAFT PHASE ADJUSTING SYSTEM

(71) Applicant: Schaeffler Technologies AG & Co. KG, Herzogenaurach (DE)

(72) Inventor: Brian Lee, Charlotte, NC (US)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 17/537,975

(22) Filed: Nov. 30, 2021

(65) Prior Publication Data

US 2022/0170393 A1 Jun. 2, 2022

Related U.S. Application Data

(60) Provisional application No. 63/120,172, filed on Dec. 1, 2020.

(51) Int. Cl.
*F01L 1/344* (2006.01)

(52) U.S. Cl.
CPC ..... *F01L 1/344* (2013.01); *F01L 1/3442* (2013.01); *F01L 2001/3445* (2013.01)

(58) Field of Classification Search
None
See application file for complete search history.

(56) References Cited

U.S. PATENT DOCUMENTS 5,417,186 A * 5/1995 Elrod ..... F01L 1/024 123/90.31
7,377,243 B2 * 5/2008 Meintschel ..... F01L 1/352 123/90.31
8,695,545 B2 4/2014 Tateno
10,823,017 B2 11/2020 Morehead et al.
2010/0175645 A1 * 7/2010 Berger ..... F01L 1/34406 123/90.15
2019/0170165 A1 * 6/2019 Chung ..... F15B 15/12
2020/0149439 A1 * 5/2020 Brown ..... F01L 1/3442
2020/0165943 A1 * 5/2020 Keefover ..... F01L 1/047

FOREIGN PATENT DOCUMENTS

DE 102013222391 A1 * 5/2014 ..... F01L 1/3442
DE 102014116191 B3 * 1/2016 ..... F01L 1/047
EP 0799976 A1 * 10/1997 ..... F01L 1/344

OTHER PUBLICATIONS

DE-102014116191-B3, English language machine translation (Year: 2016).*

* cited by examiner

*Primary Examiner* — Wesley G Harris
(74) *Attorney, Agent, or Firm* — Volpe Koenig

(57) ABSTRACT

A camshaft phaser arrangement configured for adjusting a phase between a first camshaft element and a second camshaft element is disclosed. The arrangement includes a rotor configured to be drivably connected to the first camshaft element. The rotor is configured to be selectively rotationally driven via hydraulic fluid such that rotation of the rotor phases the first camshaft element. A phasing adjuster is configured to pivot based on rotation of the rotor. The phasing adjuster includes a first engagement element configured to engage with a second engagement element on the second camshaft element, such that rotation of the rotor is configured to phase the second camshaft via the phasing adjuster.

12 Claims, 10 Drawing Sheets

MULTI-CAMSHAFT PHASE ADJUSTING SYSTEM

INCORPORATION BY REFERENCE

This application claims priority to U.S. Provisional Application No. 63/120,172, which was filed on Dec. 1, 2020, and is incorporated herein by reference in its entirety.

FIELD OF INVENTION

The present disclosure relates to camshaft phasers, and more particularly is related to a camshaft phaser for a multi-camshaft arrangement of an internal combustion (IC) engine.

BACKGROUND

Camshaft phasers are utilized within IC engines to adjust the timing of engine valve events. This is a well-known concept in order to modify performance, efficiency, and emissions. One type of camshaft phaser is a hydraulically actuated camshaft phaser in which a rotor and a stator are provided. In these arrangements, the rotor can be attached to a camshaft and actuated hydraulically in clockwise or counterclockwise directions relative to the stator to achieve variable engine valve timing.

Many different camshaft configurations are possible within IC engines. Some configurations include an intake camshaft that only actuates intake valves, and an exhaust camshaft that only actuates exhaust valves. These types of camshaft configurations can simplify efforts to independently phase the intake valve events separately from the exhaust valve events.

Other camshaft configurations can utilize a single camshaft to actuate both intake and exhaust valves; however, a single camshaft configured with both intake and exhaust lobes can make it difficult to provide phasing of the intake valves separately from the exhaust valves. For this reason, a concentric camshaft arrangement can be implemented that utilizes two camshafts, an inner camshaft and an outer camshaft, each arranged with one of either exhaust lobes or intake lobes.

It would be desirable to provide a camshaft phaser arrangement that provides separate phasing of intake and exhaust valves for a concentric camshaft while minimizing cost and packaging space.

SUMMARY

A camshaft phaser arrangement is disclosed herein that is configured for adjusting a phase between a first camshaft element and a second camshaft element. The camshaft phaser arrangement includes a stator configured to be drivably connected to a crankshaft. A rotor is configured to be drivably connected to the first camshaft element. The rotor is configured to be selectively rotationally driven such that rotation of the rotor phases the first camshaft element. A phasing adjuster is configured to pivot based on rotation of the rotor. The phasing adjuster includes a first engagement element configured to engage with a second engagement element on the second camshaft element, such that rotation of the rotor is configured to phase the second camshaft element via the phasing adjuster.

At least one cover can be included that has a pivot, and the phasing adjuster includes an opening dimensioned to be mounted on the pivot. The phasing adjuster is configured to be mounted directly adjacent to the at least one cover, in one aspect. This configuration provides an axially compact arrangement for the phasing adjuster.

The phasing adjuster includes a groove configured to receive a pin fixed to the rotor, such that the pin slides within the groove when the rotor is rotationally driven and the phasing adjuster rotates about the pivot. The at least one cover further includes a through slot that is dimensioned to receive the pin. In one aspect, the groove in the phasing adjuster has a non-linear profile.

The first engagement element and the second engagement element can include gears configured to mate with each other, in one aspect.

The first camshaft element and the second camshaft element are phased at different rates as the rotor is rotationally driven. The first camshaft element and the second camshaft element are arranged concentrically with each other, in one aspect. The first camshaft element can be configured to surround at least a portion of the second camshaft element.

A first and second cover can be arranged on respective axial sides of the rotor and the stator to partially define hydraulic chambers that are used to control rotation of the rotor. At least one of the covers can include a groove dimensioned to receive a pin attached to the rotor, and the pin can be configured to travel within a groove on the phasing adjuster to phase the second camshaft element.

Additional embodiments are disclosed herein.

BRIEF DESCRIPTION OF THE DRAWINGS

The foregoing Summary and the following Detailed Description will be better understood when read in conjunction with the appended drawings, which illustrate a preferred embodiment of the disclosure. In the drawings.

DETAILED DESCRIPTION OF THE PREFERRED EMBODIMENTS

Certain terminology is used in the following description for convenience only and is not limiting. "Axially" refers to a direction along an axis (X) of an assembly. "Radially" refers to a direction inward and outward from the axis (X) of the assembly. "Circumferentially" refers to a direction extending along a curve or circumference of a respective element relative to the axis (X) of the assembly.

A reference to a list of items that are cited as "at least one of a, b, or c" (where a, b, and c represent the items being listed) means any single one of the items a, b, or c, or combinations thereof. The terminology includes the words specifically noted above, derivatives thereof and words of similar import.

Figure 6A:
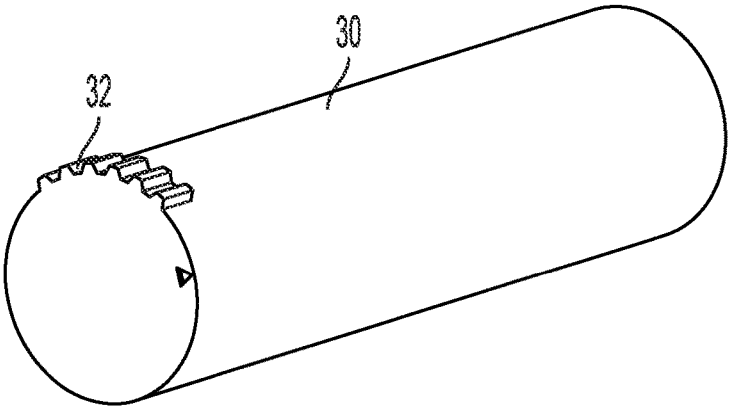
FIG. 6A is a perspective view of one of the camshaft elements of FIG. 1A.
Figure 6B:
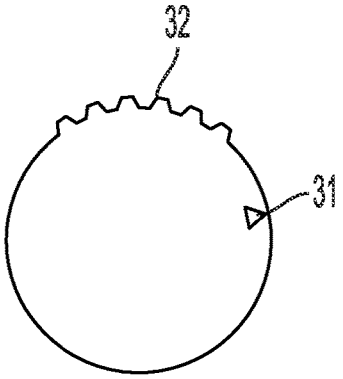
FIG. 6B is an end view of the camshaft element of FIG. 6A.
Figure 13A:
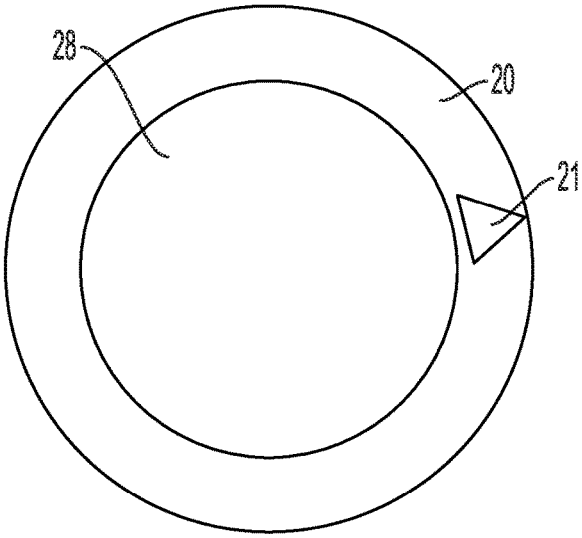
FIG. 13A is a front view of one of the camshaft elements from FIG. 1A.
Figure 13B:
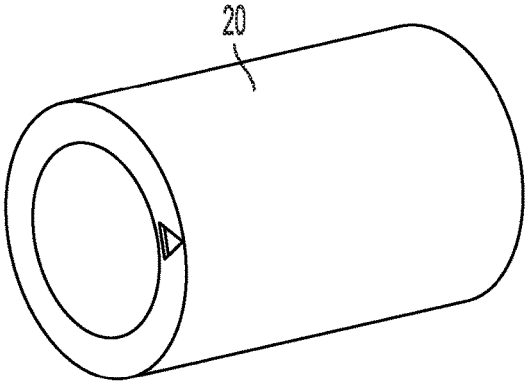
FIG. 13B is a perspective view of the camshaft element of FIG. 13A.

As shown in FIGS. 1A-5, a camshaft phaser arrangement 10 for a multi-camshaft assembly is disclosed herein. The camshaft phaser arrangement 10 generally includes a first camshaft element 20 and a second camshaft element 30. In one aspect, the first camshaft element 20 (shown in FIGS. 13A and 13B) is an outer camshaft element and the second camshaft element 30 (shown in FIGS. 6A and 6B) is an inner camshaft element. The camshaft elements 20, 30 can be arranged in a concentric configuration in one aspect.

The first and second camshaft elements 20, 30 can each be configured to be connected with or associated with intake cam lobes and/or exhaust cam lobes, such that phasing of these respective camshafts facilitates phasing of the respective intake and exhaust valve lift events within a combustion cycle of an IC engine. The first and second camshaft elements 20, 30 are connected to camshafts defining lobes, which are commonly annotated as elements 25 and shown in FIG. 1B. One of ordinary skill in the art would understand that various connections could be used to connect the first and second camshaft elements 20, 30 to a respective camshaft. One of ordinary skill in the art would recognize from this disclosure that non-rotational connection arrangements can be used to connect the camshaft elements 20, 30 with the associated camshafts, and therefore any phasing or adjustment of the camshaft elements 20, 30 via the arrangement 10 will result in a corresponding phasing or adjustment of the associated lobes 25.

Figure 8:
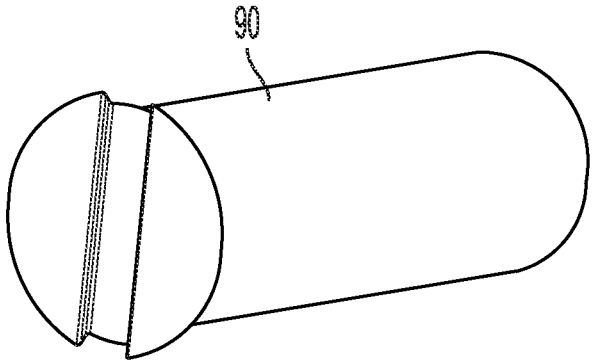
FIG. 8 is a perspective view of a fastening element for the camshaft phaser arrangement.
Figure 9A:
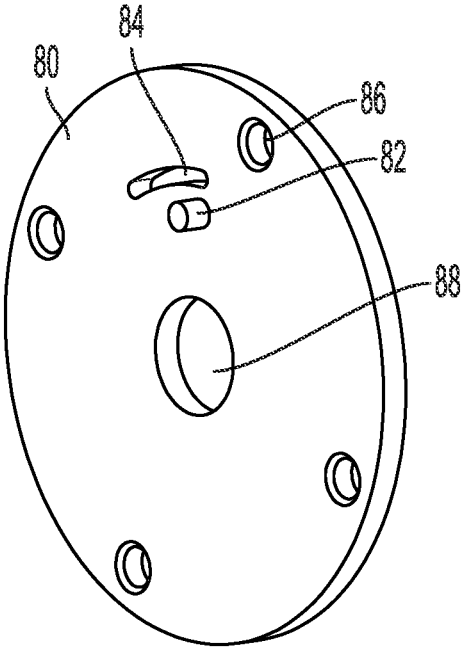
FIG. 9A is a perspective view of one of the covers of the camshaft phaser arrangement.
Figure 9B:
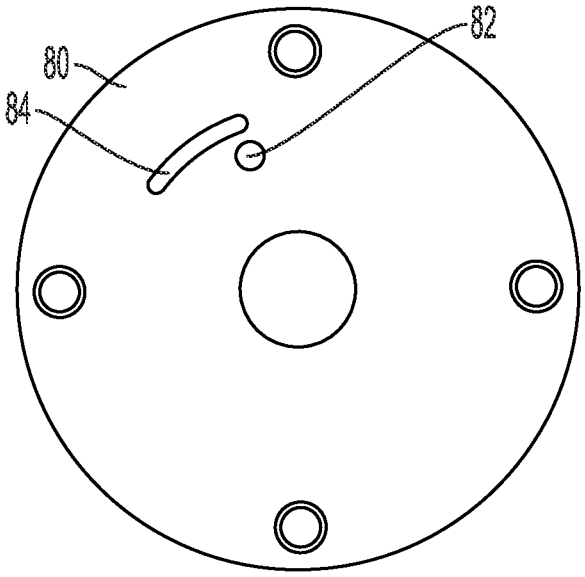
FIG. 9B is a front view of the cover of FIG. 9A.
Figure 11A:
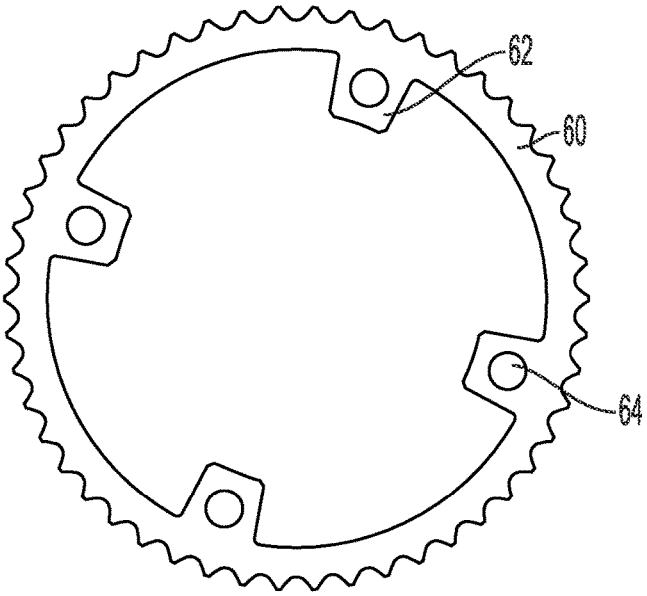
FIG. 11A is a front view of a stator of the camshaft phaser arrangement.
Figure 11B:
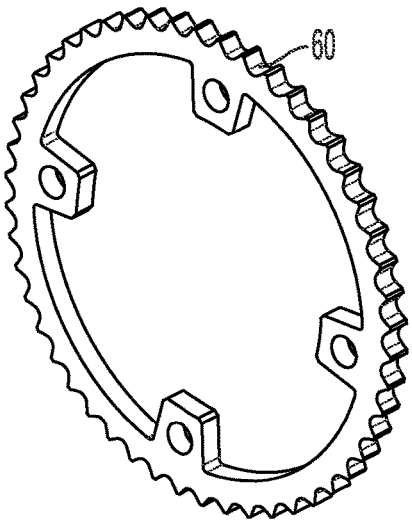
FIG. 11B is a perspective view of the stator of FIG. 11A.
Figure 12A:
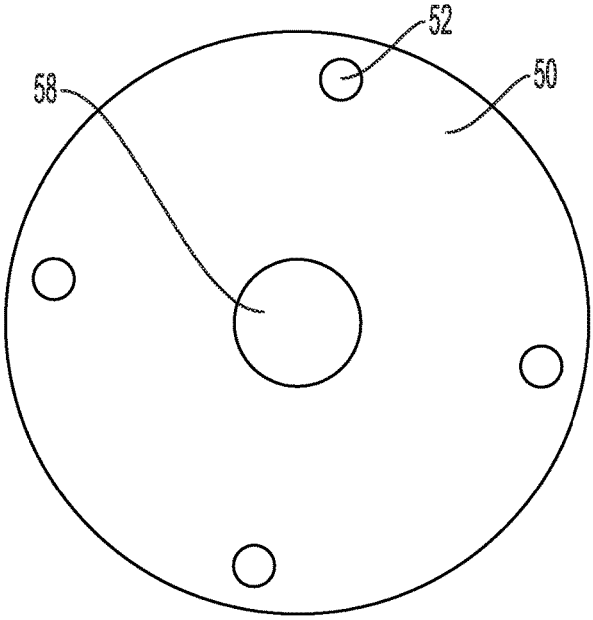
FIG. 12A is a front view of another cover for the camshaft phaser arrangement.
Figure 12B:
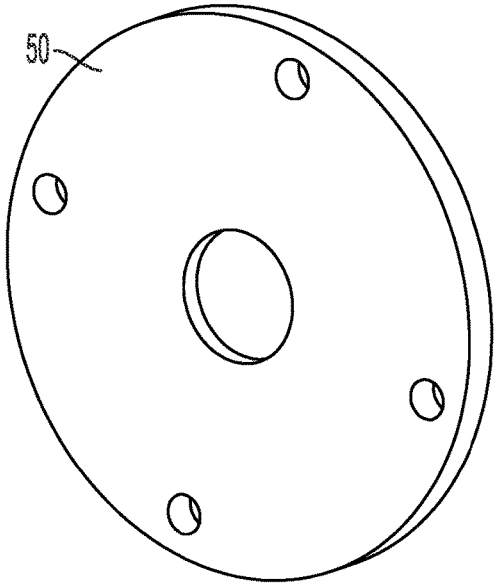
FIG. 12B is a perspective view of the cover of FIG. 12A.

In order to adjust the phase between the camshaft elements 20, 30, a phasing adjuster 40 is provided that is configured to be driven based on rotation of a rotor 70. Additional components of the arrangement 10 include covers 50, 80, and a stator 60. One of the covers 80 is shown in FIGS. 9A and 9B, the stator 60 is shown in FIGS. 11A and 11B, and another one of the covers 50 is shown in FIGS. 12A and 12B. Together with the rotor 70, these components generally define hydraulic actuator chambers, which are configured to receive and vent pressurized hydraulic fluid to move the rotor 70 clockwise or counterclockwise relative to the stator 60. These actuation chambers are formed between vanes 74 of the rotor 70 and lugs 62 of the stator 60, and are axially enclosed on opposite axial sides by the first cover 50 and the second cover 80. Fasteners 90, one of which is shown in FIG. 8, are provided to secure these various components with each other. In one aspect, the fasteners 90 extend through apertures 52 in the first cover 50, apertures 86 in the second cover 80, and apertures 64 in the stator 60. One of ordinary skill in the art would understand that other fastening arrangements can be used to secure the covers 50, 80, the stator 60, and the rotor 70 to each other. The fasteners 90 can be formed as pins, rivets, bolts, or any other type of mechanical fastener or connection element.

Figure 13C:
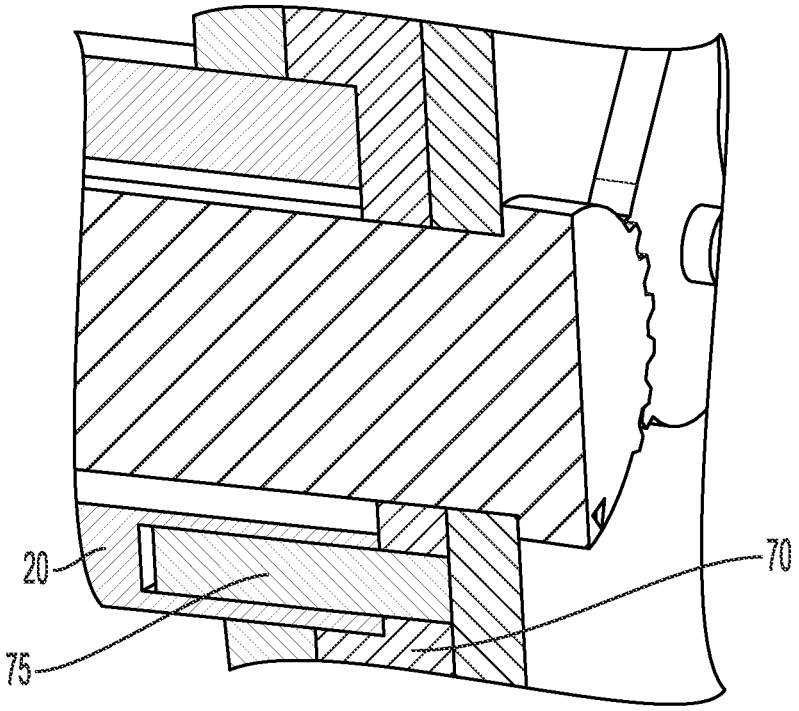
FIG. 13C is a magnified perspective view of a connection between the camshaft element of FIGS. 13A and 13B with a rotor.

The rotor 70 is generally fixed or connected to one of the camshaft elements 20, 30. In one aspect, the rotor 70 is drivably connected to the first camshaft element 20 (i.e. the outer camshaft element). For example, a fastener or some other means of attachment can be arranged between the rotor 70 and the first camshaft element 20. Bolts, rivets, or other physically connectors can be used to attach the rotor 70 to the first camshaft element 20, such as shown in FIG. 13C. As shown in FIG. 13C, the first camshaft element 20 can be connected to the rotor 70 via a pin 75. As shown in FIG. 13C, the rotor 70 can also include a shoulder for receiving the first camshaft element 20. One of ordinary skill in the art would understand that various types of connections could be used to rotationally connect the rotor 70 with the first camshaft element 20. Based on this connection, actuation (i.e. rotation) of the rotor 70 in either direction (i.e. the clockwise or counterclockwise directions) relative to the stator 60 phases the first camshaft element 20 relative to the stator 60. This rotational motion advances or retards the timing of the cam lobes on the first camshaft element 20 relative to the combustion cycle.

The phasing adjuster 40 disclosed herein allows for rotational movement of the rotor 70 to also phase the camshaft elements 20, 30 relative to each other. The phasing adjuster 40 phases the second camshaft element 30 relative to the stator 60 due to the configuration of the rotor 70.

Figure 7A:
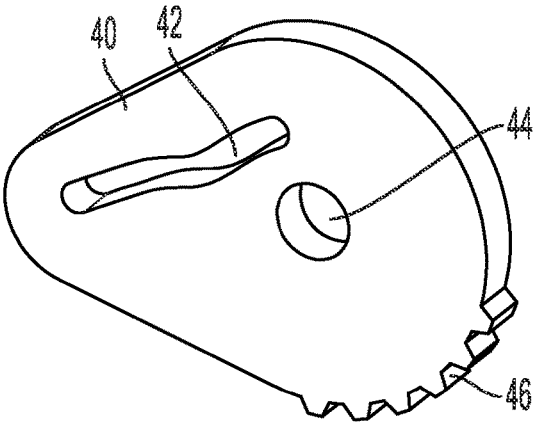
FIG. 7A is perspective view of a phasing adjuster.
Figure 7B:
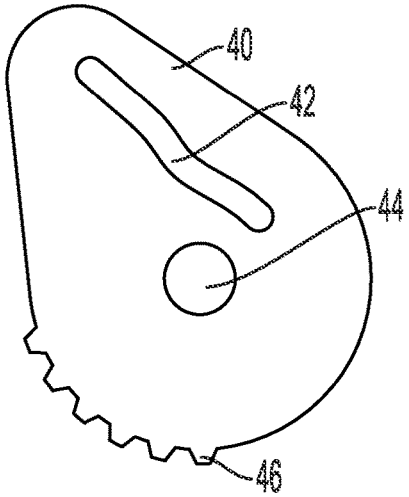
FIG. 7B is a front view of the phasing adjuster of FIG. 7A.

The phasing adjuster 40, which is shown in FIGS. 7A and 7B, can be formed as a plate that is generally configured to engage against an axial face of one of the covers, i.e. cover 80. Based on the compact configuration and placement of the phasing adjuster 40, the overall space required for the arrangement 10 is reduced. Furthermore, the camshaft phaser arrangement 10 can utilize a single hydraulic control circuit (that which is fluidly connected to the hydraulic actuation chambers formed between the rotor 70 and stator 60) to phase both camshaft elements 20, 30 unequally relative to the crankshaft or combustion cycle of the IC engine. Based on this configuration, the camshaft elements 20, 30 are configured to be phased unequal amounts. In one aspect, the phasing adjuster 40 is a follower in that the component is configured to follow the rotational motion of the rotor 70.

The phasing adjuster 40 generally includes a groove 42, a pivot bore 44, and a first engagement element 46. In order to provide a connection between the rotor 70 and the phasing adjuster 40, a pin 72 can be provided, facilitating what can be described as a cam pin and groove follower arrangement.

Figure 10A:
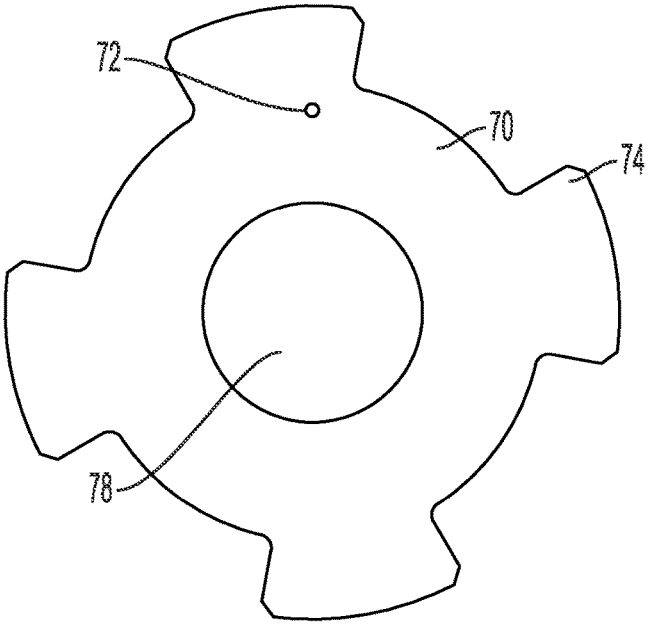
FIG. 10A is a front view of a rotor for the camshaft phaser arrangement.
Figure 10B:
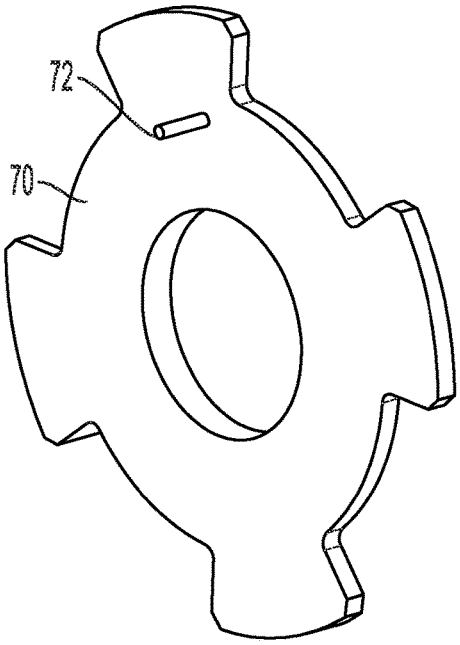
FIG. 10B is a perspective view of the rotor of FIG. 10A.

The pin 72 can be integrally formed with the rotor 70, in one aspect, as shown in FIGS. 10A and 10B. In another aspect, the pin 72 can be inserted into a bore formed on the rotor 70 to attach the pin 72 to the rotor 70. The pin 72 is dimensioned to be received within the groove 42 of the phasing adjuster 40, which provides the "following" aspect between the phasing adjuster 40 and the rotor 70. Rotation of the rotor 70 causes the pin 72 to move within the groove 42, which, in turn, causes rotation of the phasing adjuster 40.

The phasing adjuster 40 is pivotally mounted to the arrangement 10. The phasing adjuster 40 can be mounted off-axis, i.e. off of or away from a primary rotational axis of the arrangement 10. The phasing adjuster 40 does not extend around the primary rotational axis of the arrangement 10, in one aspect. The phasing adjuster 40 includes a pivot bore 44 which is dimensioned to receive a pivot, such as pivot 82, which can be provided on the second cover 80 as shown in FIGS. 9A and 9B. The pivot 82 can alternatively be formed on the other cover 50, or another component of the arrangement. The pivot 82 can be formed as a post, pin, or other type of protrusion.

Rotation of the phasing adjuster 40 about the pivot 82 causes the first engagement element 46 on the phasing adjuster 40 to rotate. In one aspect, rotation of the phasing adjuster 40 induces or drives rotation of the second camshaft element 30. This arrangement can be achieved via mating engagement elements that are formed on the phasing adjuster 40 and the second camshaft element 30. For example, a gear interface can be provided between the second camshaft element 30 and the phasing adjuster 40. Specifically, a second engagement element 32 of the second camshaft element 30, shown in FIGS. 6A and 6B, can be configured to mate, mesh, or otherwise engage with the first engagement element 46 of the phasing adjuster 40. The first and second engagement elements 32, 46 can be formed as teeth or geared portions, in one aspect. One of ordinary skill in the art would understand that various configurations could be used that provide a driving connection between the phasing adjuster 40 and the second camshaft element 30.

The second cover 80 can include a cam bore 88 that receives the first camshaft element 20. Based on the concentric arrangement of the camshaft elements 20, 30, the cam bore 88 also receives the second camshaft element 30. Likewise, the rotor 70 can include a cam bore 78, the first cover 50 can include a cam bore 58, and the first camshaft element 20 can also include a cam bore 28. As used in this context, the term cam bore can refer to an opening configured to allow passage of at least one camshaft therethrough. Additionally, the second cover 80 includes a through-slot 84 through which the pin 72 of the rotor 70 extends to engage the groove 42 of the phasing adjuster 40.

Figure 1A:
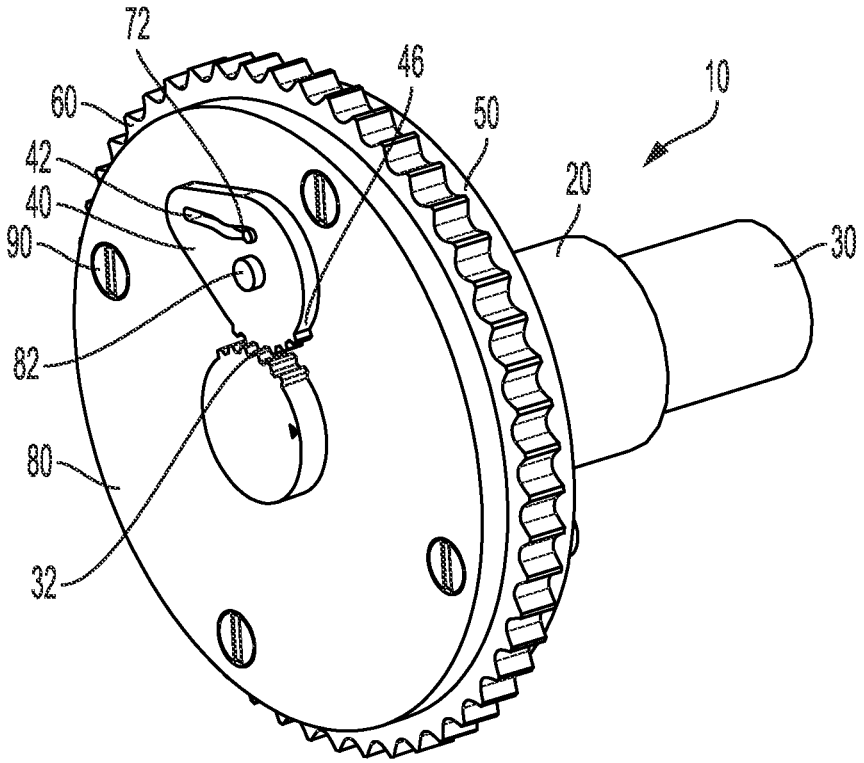
FIG. 1A is a perspective view of a camshaft phaser arrangement for a multi-camshaft system.
Figure 1B:
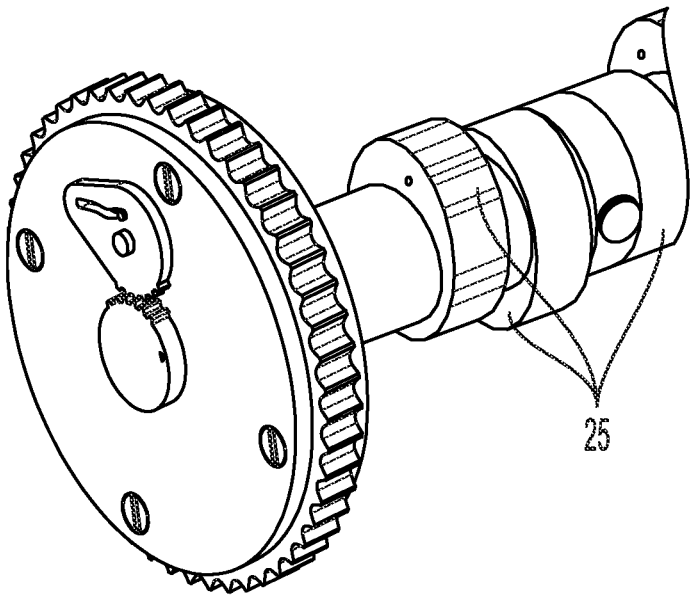
FIG. 1B is another perspective view of the camshaft phaser arrangement showing cam lobes associated with the first and second camshaft elements of FIG. 1A.
Figure 2A:
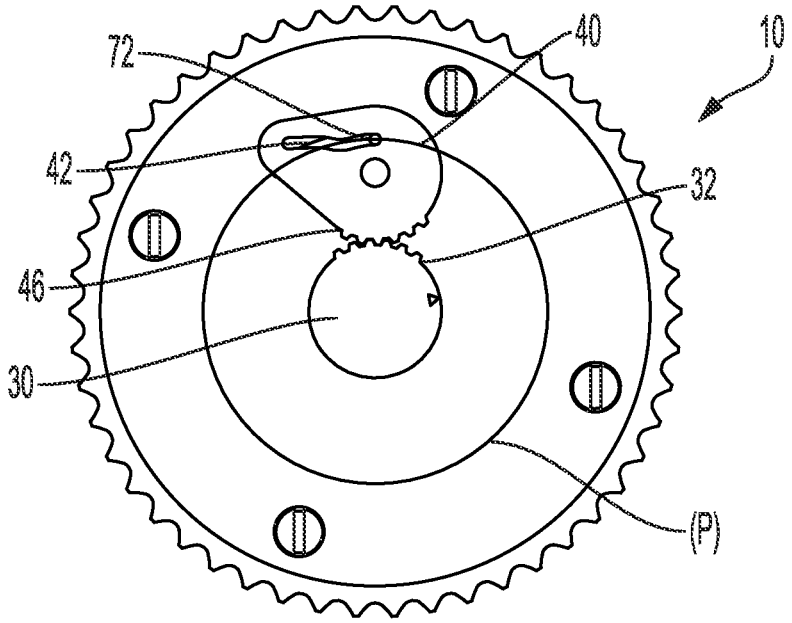
FIG. 2A is a front view of the camshaft phaser arrangement of FIGS. 1A and 1B.
Figure 2B:
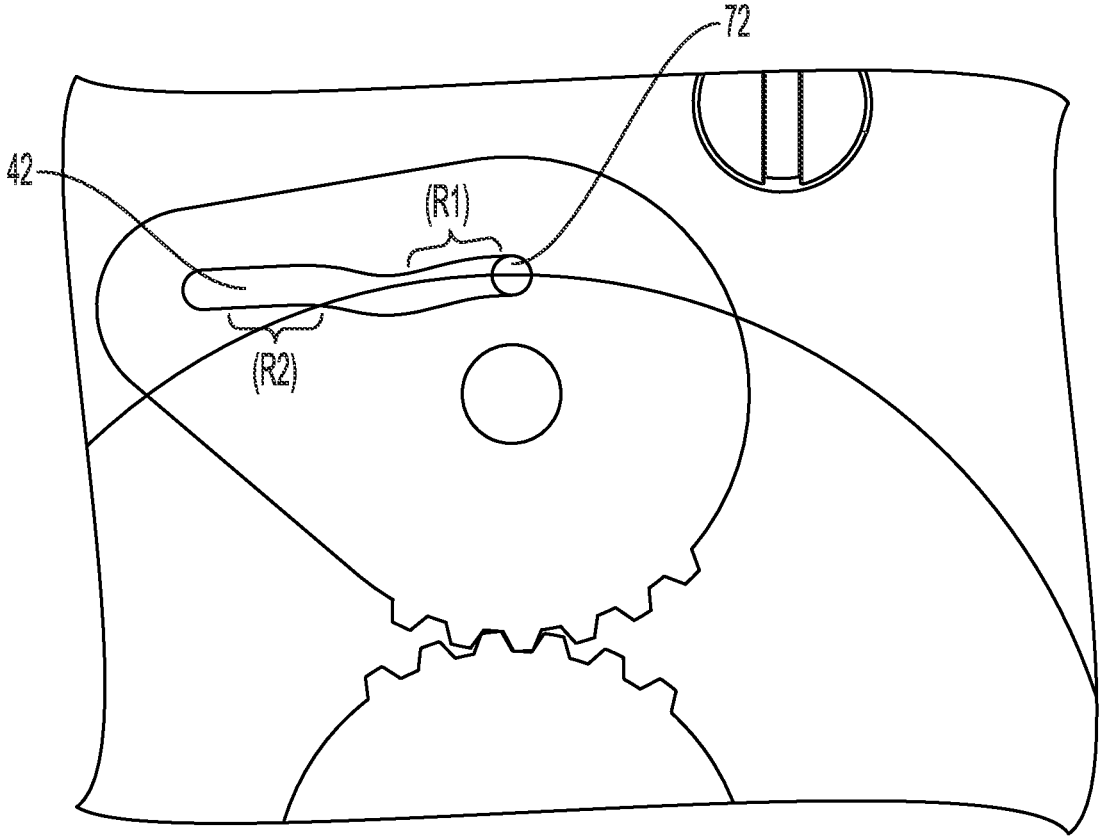
FIG. 2B is a magnified view of a portion of FIG. 2A in a first state.
Figure 2C:
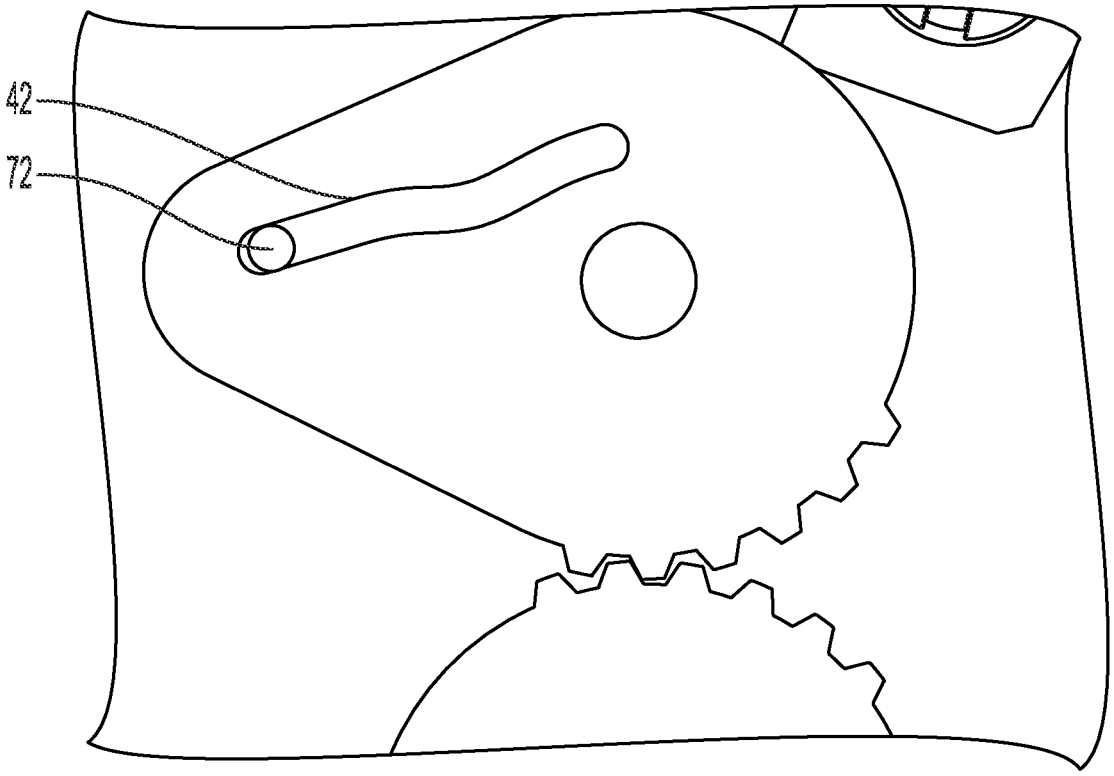
FIG. 2C is a magnified view of a portion of FIG. 2A in a second state.
Figure 3:
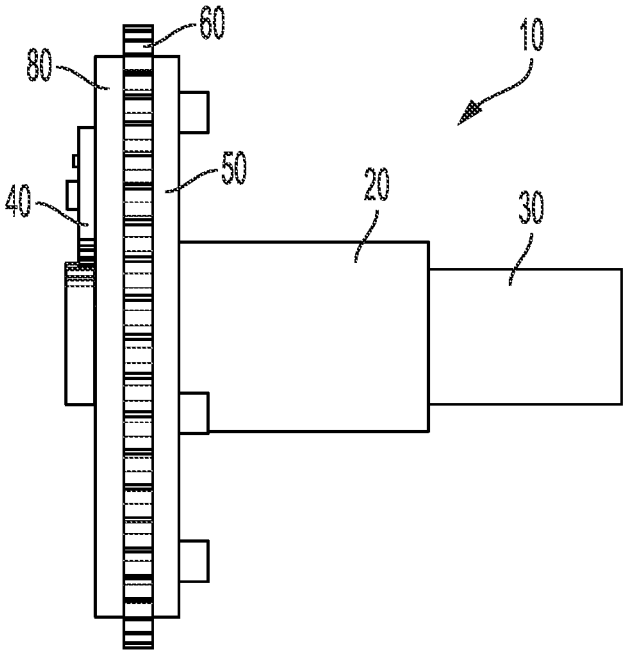
FIG. 3 is a side view of the camshaft phaser arrangement of FIG. 1A.
Figure 4:
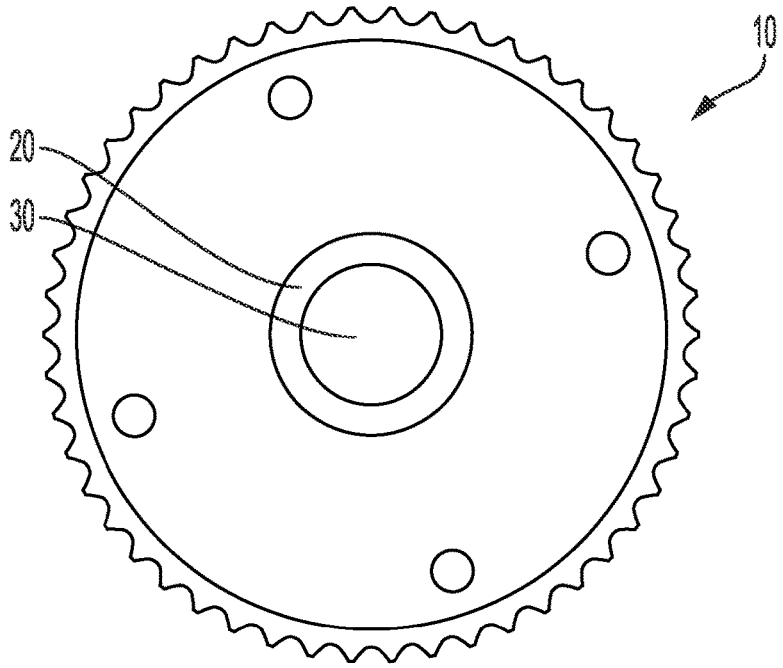
FIG. 4 is a rear view of the camshaft phaser arrangement of FIG. 1A.
Figure 5:
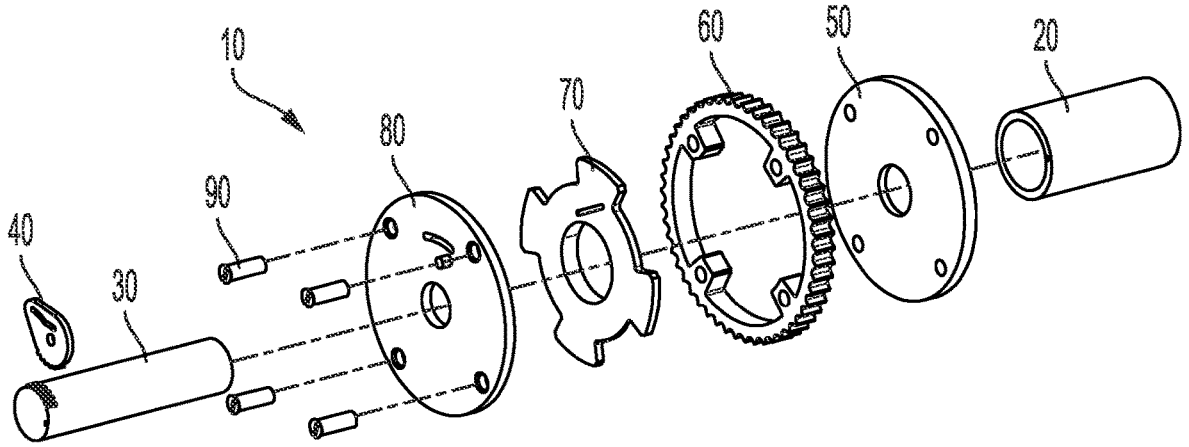
FIG. 5 is an exploded perspective view of the camshaft phaser arrangement of FIGS. 1A and 1B.

A circular pathway (P) for the pin 72 is shown in FIG. 2A, which corresponds to the rotational path of the rotor 70. As shown in FIG. 2B, as the pin 72 is driven along the pathway (P) via the rotor 70 in the counterclockwise direction, the pin 72 pushes against a side of the groove 42 in region (R1), thereby causing the phasing adjuster 40 to rotate clockwise. As the rotor 70 continues rotation in the counterclockwise direction, as shown in FIG. 2C, the pin 72 continues traveling along the pathway (P) thereby pushes against the side of the groove 42 shown as region (R2), and causing the phasing adjuster 40 to also rotate counterclockwise. Accordingly, the shape and form of the groove 42 can facilitate a reversing action or motion of the phasing adjuster 40.

Figure 14A:
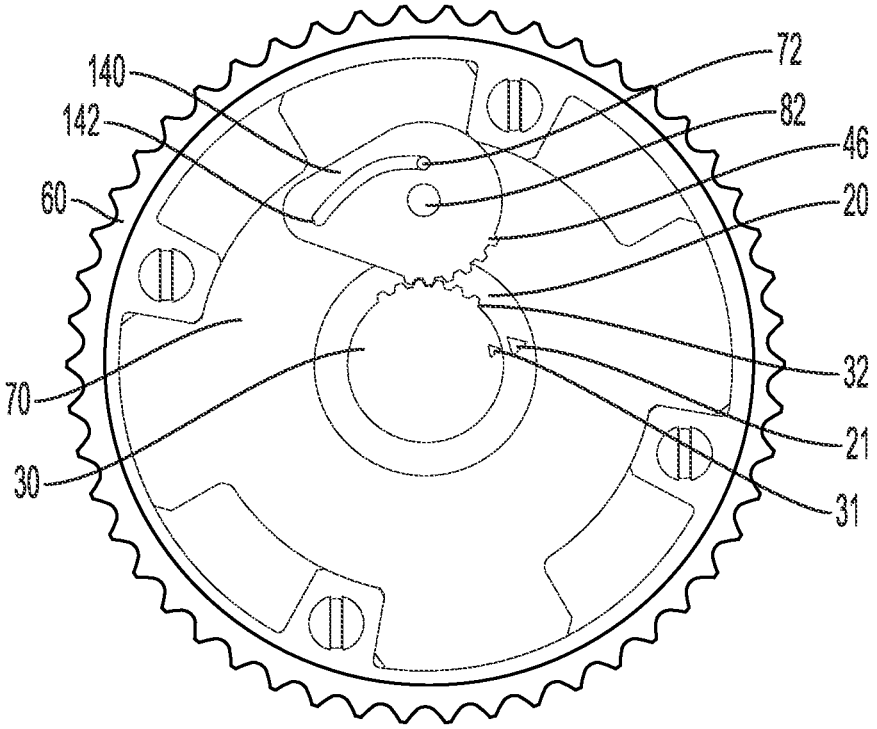
FIG. 14A is an end view of another camshaft phaser arrangement in a first state.
Figure 14B:
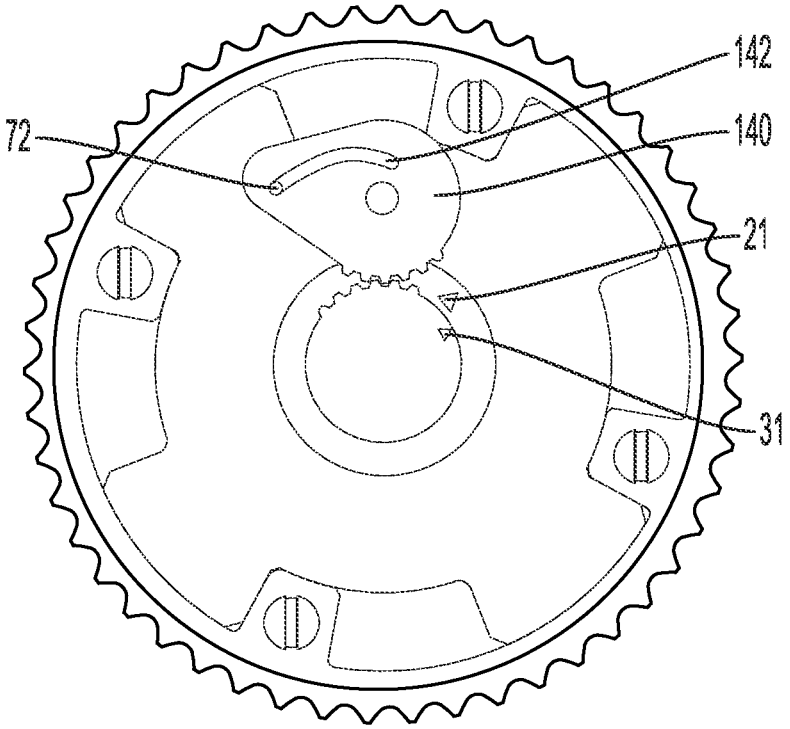
FIG. 14B is an end view of the camshaft phaser arrangement of FIG. 14A in a second state.

The geometry or shape of the groove 42 on the phasing adjuster 40 can vary. For example, the groove 42 shown in FIGS. 1A, 1B, 2A-2C, 7A, and 7B, generally has a curvature that is open or facing in a radially outward direction. In another example shown in FIGS. 14A and 14B, the phasing adjuster 140 includes a groove 142 having a curvature that is open or facing in a radially inward direction. In other words, the concavity of the two grooves 42, 142 are opposite from each other. The other components shown in FIGS. 14A and 14B, such as the rotor, stator, etc., are otherwise similar to the components described herein and use the same reference numeral for similar elements. FIGS. 14A and 14B illustrate two different states for the camshaft phaser arrangement. In FIG. 14A, the first and second camshaft elements 20, 30 are in a first phasing position or relationship. Markers 21, 31 on the camshaft elements 20, 30 are generally aligned with each other in FIG. 14A. As the rotor 70 rotates counter-clockwise from FIG. 14A to FIG. 14B, the pin 72 is also rotationally driven within the groove 142 of the phasing adjuster 140 and presses against sides of the groove 142 to rotate the phasing adjuster 140. Based on the profile of the groove 142, as shown in FIG. 14A, as the pin 72 is driven via the rotor 70 in the counterclockwise direction, the pin 72 pushes against a side of the groove 142, thereby causing the phasing adjuster 140 to initially rotate counterclockwise. As the rotor 70 continues rotation in the counterclockwise direction, as shown in FIG. 14B, the pin 72 pushes against the side of the groove 142 causing the phasing adjuster 140 to rotate clockwise.

Figure 15:
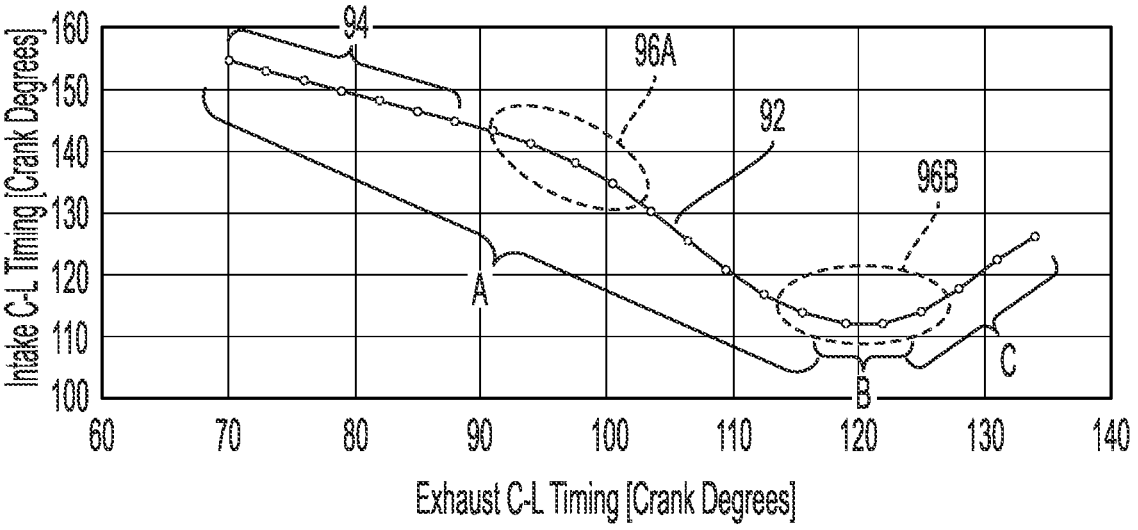
FIG. 15 is a graph plotting the cam timing of the first camshaft versus the second camshaft.

In one aspect, the shape of the groove 42 determines the relative movement of the first and second camshaft elements 20, 30. For example, the groove 42 shown in FIGS. 7A and 7B provides a phasing characteristic trace 92 plotted in FIG. 15, which shows intake versus exhaust center-line (C-L) timing. As shown in FIG. 15, the trace 92 includes both a linear portion 94 and non-linear portions 96A, 96B. The linear portion 94 represents a constant relative rate of phasing magnitude between the first and second camshaft elements 20, 30. The non-linear portions 96A, 96B represent a non-constant relative rate of phasing magnitude between the first and second camshaft elements 20, 30. Additionally, the non-linear portion 96B facilitates a reversing motion of the phasing adjuster 40. The shape of the phasing characteristic trace 92 can be changed or tuned by adjusting the geometry or shape of the groove 42 and the groove's position relative to the circular path of the pin 72. Based on the configurations between the camshaft elements 20, 30, the phasing adjuster 40, and the rotor 70, a rate of change of phasing magnitude of the camshaft elements 20, 30 relative to each other is non-constant (i.e. variable) as the rotor 70 rotates.

As shown in FIG. 15, a negative slope portion (A) is defined based on counterclockwise rotation of phasing adjuster 40, and clockwise rotation of the second camshaft element 30. During this phase, as the first camshaft element 20 and the rotor 70 rotate counterclockwise together, the second camshaft element 30 rotates clockwise. A region (B) corresponds to a plateau which represents a transitional location where the graph changes from a decreasing (or negative) slope to an increasing (or positive) slope. One of ordinary skill in the art would understand that in finer x-axis increments, this linear segment could be more curved and have what is geometrically termed a turning point or inflection point that represents a point on the graph where the graph changes from decreasing to increasing. This area on the graph also represents a transition from clockwise rotation of the phasing adjuster 40 to counterclockwise rotation of the phasing adjuster 40, and vice versa. After region (B), another region (C) is provided on the chart that corresponds to a positive slope portion. In this region, clockwise rotation of the phasing adjuster 40 causes counterclockwise rotation of the second camshaft element 30. As the first camshaft element 20 and rotor 70 rotate counterclockwise together, the second camshaft element 30 rotates further counterclockwise relative to the first camshaft element 20. As shown in FIG. 15, as "x" increases, "y" increases slowly at first and then more rapidly, as dictated by the slope of the segments.

In one aspect, the present disclosure provides a method or configuration for modifying the phasing relationship between the first and second camshaft elements 20, 30. As disclosed herein, modifying the degree of curvature, length, profile, and other characteristics of the groove 42 of the phasing adjuster 40 is configured to alter the phasing relationship between the first and second camshaft elements 20, 30.

Movement of the pin 72 along the groove 42 causes the phasing adjuster 40 to rotate about pivot 82. As a result of the rotation of the phasing adjuster 40, the first engagement element 46 formed on the phasing adjuster 40 drivingly engages against the second engagement element 32 of the second camshaft element 30. Based on the mating engagement between the first engagement element 46 and the second engagement element 32, the second camshaft element 30 is phased or rotated.

Having thus described the present disclosure in detail, it is to be appreciated and will be apparent to those skilled in the art that many physical changes, only a few of which are exemplified in the detailed description of the invention, could be made without altering the inventive concepts and principles embodied therein.

It is also to be appreciated that numerous embodiments incorporating only part of the preferred embodiment are possible which do not alter, with respect to those parts, the inventive concepts and principles embodied therein.

The present embodiment and optional configurations are therefore to be considered in all respects as exemplary and/or illustrative and not restrictive, the scope of the embodiments being indicated by the appended claims rather than by the foregoing description, and all alternate embodiments and changes to this embodiment which come within the meaning and range of equivalency of said claims are therefore to be embraced therein.

LOG OF REFERENCE NUMERALS camshaft phaser arrangement 10
first camshaft element 20
marker 21
lobes 25
cam bore 28
second camshaft element 30
marker 31
second engagement element 32
phasing adjuster 40, 140
groove 42, 142
opening 44
first engagement element 46
first cover 50
apertures 52
cam bore 58
stator 60
lugs 62
apertures 64
rotor 70
pin 72
vanes 74
pin 75
cam bore 78
cover 80
pivot 82
through slot 84
apertures 86
cam bore 88
fasteners 90
phasing characteristic trace 92
linear portion 94
non-linear portion 96A
non-linear portion 96B

What is claimed is:

1. A camshaft phaser arrangement configured for adjusting a phase between a first camshaft element and a second camshaft element, the camshaft phaser arrangement comprising:

a stator configured to be drivably connected to a crankshaft;

a rotor configured to be drivably connected to the first camshaft element, the rotor being configured to be selectively rotationally driven such that rotation of the rotor is configured to phase the first camshaft element;

a first and second cover arranged on respective axial sides of the rotor and the stator to partially define hydraulic chambers; and a phasing adjuster configured to pivot based on rotation of the rotor, the phasing adjuster including a first engagement element configured to engage with a second engagement element on the second camshaft element, such that rotation of the rotor is configured to phase the second camshaft element via the phasing adjuster;

wherein the first camshaft element and the second camshaft element are arranged concentrically with each other, and wherein at least one of the first or second covers includes a through slot dimensioned to receive a pin attached to the rotor, and the pin is configured to travel within a groove on the phasing adjuster to phase the second camshaft element.

2. The camshaft phaser arrangement according to claim 1, wherein the first or second cover includes a pivot, and the phasing adjuster includes an opening dimensioned to be mounted on the pivot.

3. The camshaft phaser arrangement according to claim 2, wherein the phasing adjuster is configured to be mounted directly adjacent to the first or second cover.

4. The camshaft phaser arrangement according to claim 2, wherein the pin is fixed to the rotor and slides within the groove when the rotor is rotationally driven and the phasing adjuster rotates about the pivot.

5. The camshaft phaser arrangement according to claim 4, wherein the groove has a non-linear profile.

6. The camshaft phaser arrangement according to claim 1, wherein the first engagement element and the second engagement element include gears configured to mate with each other.

7. The camshaft phaser arrangement according to claim 1, wherein the first camshaft element and the second camshaft element are phased at different rates as the rotor is rotationally driven, and the phasing adjuster is mounted off-axis from a primary rotational axis of the camshaft phaser arrangement.

8. The camshaft phaser arrangement according to claim 1, wherein the first camshaft element surrounds at least a portion of the second camshaft element.

9. The camshaft phaser arrangement according to claim 1, wherein the phasing adjuster is mounted away from a primary rotational axis of the camshaft phaser arrangement.

10. A camshaft phaser arrangement configured for adjusting a phase between a first camshaft element and a second camshaft element, the camshaft phaser arrangement comprising:

a stator configured to be drivably connected to a crankshaft;

a rotor configured to be drivably connected to the first camshaft element, the rotor being configured to be selectively rotationally driven such that rotation of the rotor is configured to phase the first camshaft element; and a phasing adjuster configured to pivot based on rotation of the rotor, the phasing adjuster including a first engagement element configured to engage with a second engagement element on the second camshaft element, such that rotation of the rotor is configured to phase the second camshaft element via the phasing adjuster, wherein the phasing adjuster includes a groove configured to receive a pin fixed to the rotor, such that the pin slides within the groove when the rotor is rotationally driven and the phasing adjuster rotates about a pivot axis;

wherein the first camshaft element and the second camshaft element are arranged concentrically with each other.

11. The camshaft phaser arrangement according to claim 10, wherein at least one cover further includes a through slot that is dimensioned to receive the pin.

12. The camshaft phaser arrangement according to claim 10, wherein the groove has a non-linear profile.

* * * * *